US005205214A

United States Patent [19]

Seo et al.

[11] Patent Number: 5,205,214

[45] Date of Patent: Apr. 27, 1993

[54] STAMP DEVICE HAVING CONTROLLED PROJECTION AMOUNT OF INK PAD FROM PAD HOLDER

[75] Inventors: Keiji Seo; Takashi Miki, both of Nagoya, Japan

[73] Assignee: Brother Kogyo Kabushiki Kaisha, Aichi, Japan

[21] Appl. No.: 887,149

[22] Filed: May 22, 1992

[30] Foreign Application Priority Data

May 27, 1991 [JP] Japan ..... 3-037516[U]
Mar. 3, 1992 [JP] Japan ..... 4-045523

[51] Int. Cl.[5] ..... B41K 1/42

[52] U.S. Cl. ..... 101/333; 101/103; 101/327

[58] Field of Search ..... 101/333, 328, 327, 405, 101/406, 125, 128.4, 114, 103, 108

[56] References Cited

U.S. PATENT DOCUMENTS

| | | | |
|---|---|---|---|
| 2,499,472 | 3/1950 | Dyal | 101/121 |
| 3,608,481 | 9/1971 | Price | 101/108 |
| 4,594,943 | 6/1986 | Nettesheim et al. | 101/405 |
| 5,111,745 | 5/1992 | Wilson | 101/333 |

FOREIGN PATENT DOCUMENTS

| | | | |
|---|---|---|---|
| 0291654 | 5/1914 | Fed. Rep. of Germany | 101/108 |
| 710285 | 8/1931 | France . | |
| 54-9523 | 1/1979 | Japan . | |
| 0154881 | 7/1986 | Japan | 101/128.4 |
| 0073988 | 4/1987 | Japan | 101/114 |
| 0055417 | 4/1921 | Sweden | 101/103 |

*Primary Examiner*—Edgar S. Burr
*Assistant Examiner*—Anthony H. Nguyen
*Attorney, Agent, or Firm*—Oliff & Berridge

[57] ABSTRACT

Print density of a print ink can be adjusted depending on the quality of a print paper or depending on the printing times. A stamp device includes an outer frame, a hand-gripped pressure unit movably supported by the outer frame, an ink cartridge, a pad holder and projection length adjusting unit. The ink cartridge has an ink-impregnated pad contactable with an image receiving sheet through a perforated stencil paper for transferring an ink in the pad to the image receiving sheet through the perforated imaging section. The pad holder supports the ink cartridge. The pressure unit is connected to the pad holder for providing projected and retracted positions of the ink-impregnated pad relative to the outer frame. The projection length adjusting means is positioned between the pad holder and the ink cartridge for adjusting a projecting amount of the ink-impregnated pad from the pad holder.

17 Claims, 8 Drawing Sheets

STAMP DEVICE HAVING CONTROLLED PROJECTION AMOUNT OF INK PAD FROM PAD HOLDER

BACKGROUND OF THE INVENTION

The present invention relates to a stamp device, and more particularly to a stamp device which employs a heat-sensitive stencil paper perforatable by an infrared radiation or a thermal head.

There are known portable small-size stamp devices which employ a stencil paper that has been perforated in the pattern of characters, figures, etc. with a stylus or a ball-point pen.

One conventional stamp device, as disclosed in Japanese patent publication (Kokoku) No. 54-9523, is illustrated in FIG. 1. The stamp device includes a housing frame 200 and an ink applicator unit 202 housed therein. The ink applicator unit 202 bears a stencil paper 204, and is reciprocally supported by an ink applicator unit holder 205. One extreme reciprocating position of the applicator unit 202 provides mimeographic operation, and another extreme reciprocating position of the applicator unit provides a rest position.

There are also known stamp devices employing a heat-sensitive stencil paper that can be perforated by an infrared radiation or a thermal head. One typical heat-sensitive stencil paper is composed of a thermoplastic film and a thin porous paper that are bonded to each other by an adhesive.

In these conventional stamp devices, printing density must be adjusted in accordance with a kind of an image receiving sheet or a print paper, since permeability of the ink relative to the print paper may be different from one another with respect to each kind of the print paper. In other words, it is necessary to change ink transferring amount from the ink applicator to the print paper in accordance with the kinds of the print paper. However, since the ink applicator unit 202 projects a fixed distance from the ink applicator unit holder 205, the only actual method of adjusting the print ink density has been for the user to adjust the pressure under which the ink applicator unit 202 is pressed against the print paper. Such adjusting method is difficult to perform in achieving the desired print ink density, and is highly disadvantageous.

Further, due to another reason, there may be the case in which the projecting amount of the ink applicator unit 202 from the housing frame 200 must be changed.

SUMMARY OF THE INVENTION

In view of the aforesaid drawbacks, it is an object of the present invention to provide a means for adjusting projecting amount of the ink applicator unit from the housing frame.

Another object of the invention is to provide such stamp device capable of providing an inked image having constant density on the print paper regardless of the variation in ink permeability among different types of print paper.

These and other objects of the present invention will be attained by providing a stamp device for providing an inked image on an image receiving sheet through a heat sensitive stencil paper in which a perforated image section is formed, the stamp device comprising; (a) an outer frame, (b) a pressure means movably supported by the outer frame, (c) an ink cartridge having an ink-impregnated pad contactable with the image receiving sheet through the perforated stencil paper for transferring an ink in the ink-impregnated pad to the image receiving sheet through the perforated imaging section, (d) a pad holder for supporting the ink cartridge, the pressure means being connected to the pad holder for providing projected and retracted positions of the ink-impregnated pad relative to the outer frame, and (e) projection length adjusting means positioned between the pad holder and the ink cartridge for adjusting a projecting amount of the ink-impregnated pad from the pad holder.

In a first embodiment of this invention, the projection length adjusting means includes a paper quality mode selector switch, a stepper motor, and an eccentric cam.

A paper quality mode corresponding to the type of the print paper used is set by the paper quality mode selector switch, and a motor controller energizes the stepper motor to move the ink cartridge vertically. When a print paper of higher ink permeability is used, the stepper motor rotates the eccentric cam into an angular position to increase the projection of the ink cartridge from the pad holder for thereby increasing the volume of the ink-impregnated pad which is pressed. When a print paper of lower ink permeability is used, the stepper motor rotates the eccentric cam into an angular position to reduce the projection of the ink cartridge from the pad holder for thereby reducing the volume of the ink-impregnated pad which is pressed. In this manner, the projection of the ink-impregnated pad from the pad holder is adjusted depending on the quality of the print paper used for thereby controlling the print density.

In a second embodiment of this invention, the pressure amount at the time of printing by the presser means is regulated by the pad holder. The control means controls the pad holder such that the pressure amount provided by the pad holder is increased in accordance with the printing times for further compressing the ink-impregnated pad. Thus, the ink retained at the upper portion of the ink-impregnated pad can be flowed toward the heat sensitive stencil paper.

BRIEF DESCRIPTION OF THE DRAWINGS

In the drawings;

FIG. 5(*b*) is a partial enlarged view showing an ink cartridge and surrounding parts according to the embodiment at the time where an ink-impregnated pad has a largest projecting position;

FIG. 5(*c*) is a partial enlarged view showing the ink cartridge and surround parts according to the embodiment at the time where the ink impregnated pad has a smallest projecting position;

DETAILED DESCRIPTION OF THE PREFERRED EMBODIMENTS

A stamp device according to a first embodiment of the present invention will hereinafter be described with reference to FIGS. 2 through 5(*c*).

Figure 2:
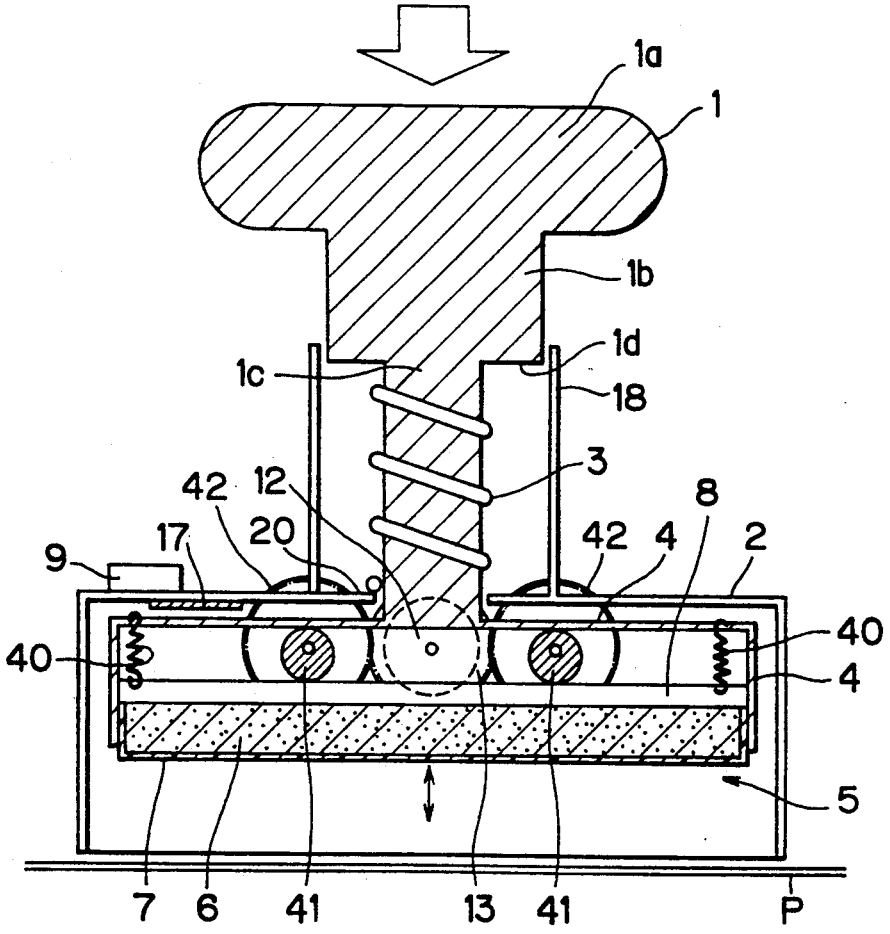
FIG. 2 is a cross-sectional view showing a stamp device according to a first embodiment of the present invention.

As shown in FIG. 2, the stamp device generally includes a grip (pressure means) 1, an outer frame 2, an ink cartridge 5, and a cartridge holder 4. The grip 1 has a grip portion 1*a*, a first shaft portion 1*b*, a second shaft portion 1*c* having a diameter smaller than that of the first shaft portion 1*b*. A stepped portion 1*d* is defined between the first and the second shaft portions 1*b* and 1*c*.

The ink cartridge 5 is composed of an ink-impregnated pad 6 formed of a porous material and a pad securing plate 8 coupled to an upper portion of the pad 6. A heat-sensitive stencil paper 7 is supported to the ink-impregnated pad 6 and is in contact with a lower surface thereof. The ink-impregnated pad 6 is adapted to face with a print paper P when printing. The ink cartridge 5 is movably attached to an ink cartridge holder 4 movably housed in the cuter frame 2 by tension springs 40. The ink cartridge 5 is urged upwardly by biasing forces of the tension springs 40.

The ink cartridge holder 4 is directly coupled to a lower end of the grip 1. Further, a compression spring 3 is interposed between the stepped portion 1*d* of the grip 1 and an engaging portion 20 of the outer frame 2 so as to normally urge the grip 1 upwardly relative to the outer frame 2. Thus, the ink cartridge holder 4 is also held upwardly against the outer frame 2 under the bias of the compression spring 3. When the stamp device is not pressed, the ink cartridge holder 4 is held against the base 2 by the compression spring 3 to keep the heat-sensitive stencil paper 7 of the ink cartridge 5 out of contact with a print paper 8. The base 2 serves to secure the stamp device with respect to the print paper 8.

When the grip 1 is pressed downwardly, the ink cartridge 5 moves downwardly against the biasing force of the coil spring 3 until the heat-sensitive stencil paper 7 contacts the print paper P, for starting transfer of the ink to the print paper P.

Figure 3:
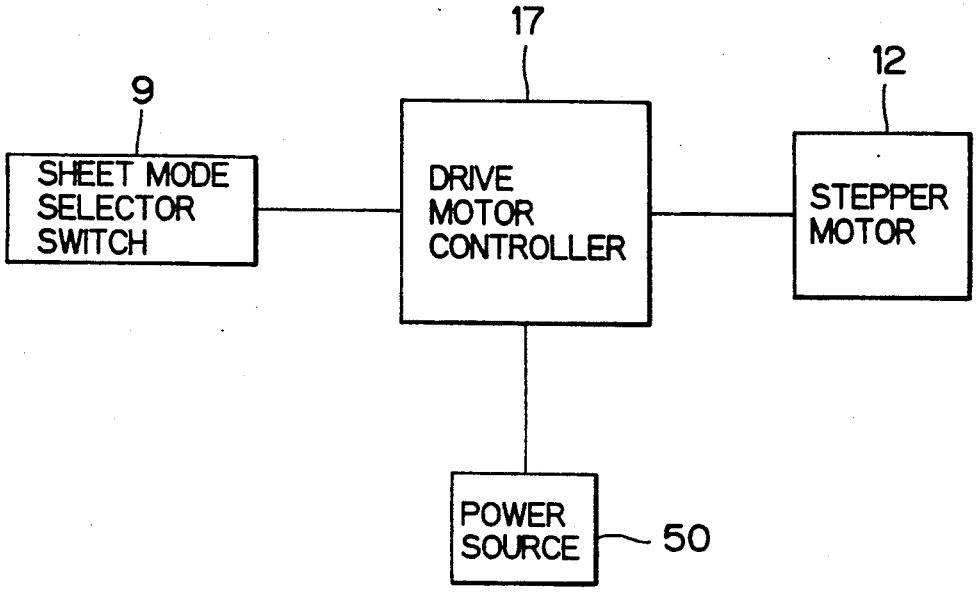
FIG. 3 is a block diagram showing an electric circuit used in connection with the stamp device according to the embodiment of the present invention.

A projection adjusting means is provided in the first embodiment so as to control projection length of the ink-impregnated pad 6 from a lower edge of the cartridge holder 4. To this effect, two eccentric cams 41 are interposed between the ink cartridge 5 and the cartridge holder 4. Further, a step motor 12 is disposed between the eccentric cams 41 and 41 for rotating the latter. Rotation of the step motor 12 is controllable by a drive motor controller 17 (FIG. 3). More specifically, the step motor 12 has a drive shaft coaxially coupling a drive gear 13. Further, the each of the eccentric cams 41 is coupled, through cam shafts 44, with driven or cam gears 42 meshedly engageable with the drive gear 13. Thus, the rotation of the step motor 12 is transmitted to the gear 13 and then the pair of cam gears 42. The cam gears 42 then rotate respective eccentric cams 41 coupled thereto for thereby vertically moving the ink cartridge 5 relative to the cartridge holder 4 against the biasing force of the springs 40.

A bearing is provided at the cartridge holder 4 for supportingring the cam shaft 44. The bearing is constituted by a one-way clutch 43 so as to avoid reverse rotation of the cams 41 and to permit the cam shaft 44 to be rotated in one direction only. The one-way clutch 43 is force-fitted with the holder 4.

An electric circuit of the stamp device according to this embodiment will be described with reference to FIG. 3. The stamp device has a paper quality selector switch 9 (also see FIG. 2) connected to the drive motor controller 17. The drive motor controller 17 is connected to the step motor 12 for controlling the step motor 12 in a manner depending on the quality of the print paper P used. Thus, the drive motor controller 17 is supplied with a signal from the paper quality mode selector switch 9. The drive motor controller 17 is energized by a power supply 50 connected thereto.

Figure 4:
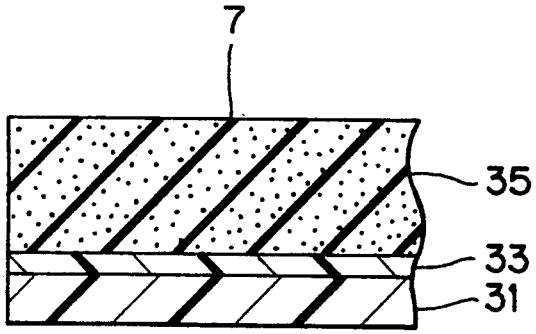
FIG. 4 is a fragmentary cross-sectional view showing a heat-sensitive stencil paper used in the stamp device according to the embodiment of the present invention.

As shown in FIG. 4, the heat-sensitive stencil paper 7 is composed of a thermoplastic film 31, an adhesive layer 33, and a porous support layer 35. The thermoplastic film 31 and the porous support layer 35 are bonded to each other by the adhesive layer 33. In this embodiment, the thermoplastic film 31 is formed of a polyethylene terephthalate film (hereinafter referred to as a "PET film") having a thickness of 2 $\mu$. However, the thermoplastic film 31 can be formed of a film of polypropylene, a copolymer of vinylidene chloride and vinyl chloride, or the like.

The thickness of the PET film 31 should preferably be in the range of from 1 $\mu$ to 4 $\mu$. If the thickness were less than 1 $\mu$, then the PET film would be too high in cost, too low in mechanical strength, and hence not practical. If the thickness were greater than 4 $\mu$, then it would be too thick to be perforated by a general thermal head having a rated thermal output power of 50 $m/mm^2$.

The porous support layer 35 may be formed of a thin porous paper mainly made of natural fibers of Manila hemp, paper mulberry, paper bush, or the like, or synthetic fibers of polyethylene terephthalate, polyvinyl alcohol, polyacrylonitrile, or the like, or semisynthetic fibers of rayon or the like.

Operation of the stamp device according to the first embodiment will be described.

First, an image to be printed is formed in the heat-sensitive stencil paper 7. Specifically, the thermoplastic film 31 of the heat-sensitive stencil paper 7 is selectively melted with heat depending on image information by the thermal head or the like, so that a perforated image corresponding to the image information is formed in the heat-sensitive stencil paper 7. The perforated image area of the heat-sensitive stencil paper 7 is then attached to the ink-impregnated pad 6 with the porous support layer 35 held intimately against the ink-coated surface of the ink-impregnated pad 6.

Then, a paper quality mode corresponding to the type of the print paper P used is set by the paper quality mode selector switch 9, and the drive motor controller 17 energizes the step motor 12 to rotate the cams 41, 41, to thereby move the ink cartridge 5 vertically. The projection of the ink-impregnated pad 6 from the ink cartridge holder 4 is therefore adjusted to achieve a print density depending on the quality of the print paper P.

Figure 5A:
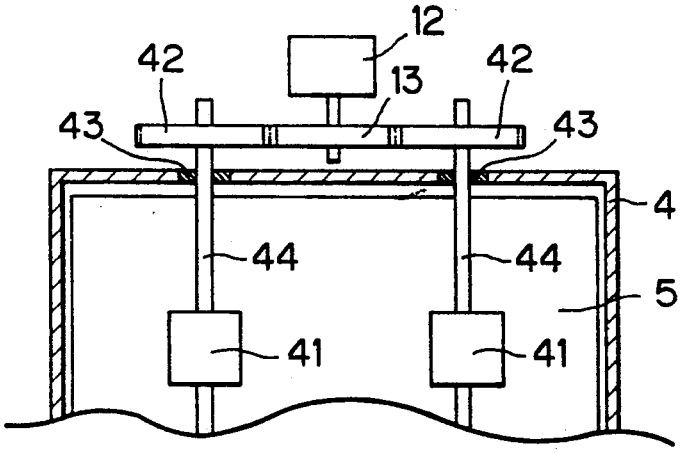
FIG. 5(*a*) is a plan view showing the stamp device according to the embodiment.
Figure 5B:
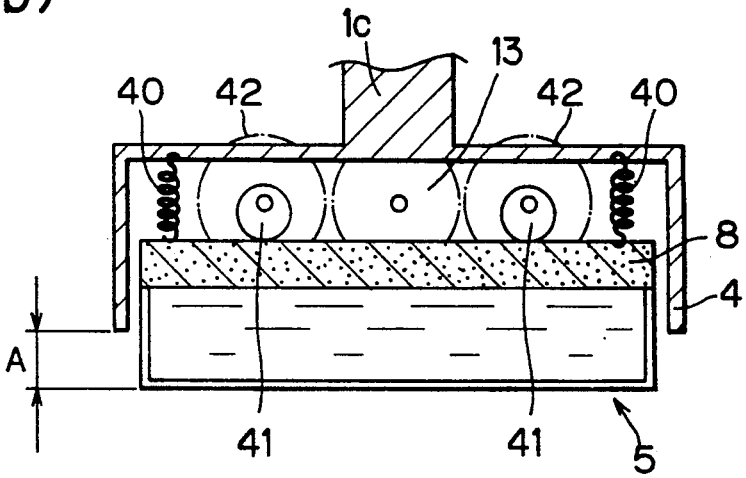
Figure 5C:
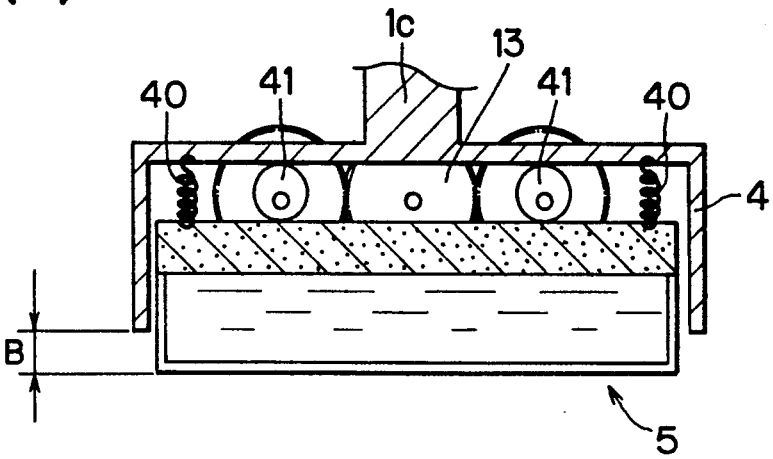

More specifically, when the print paper P is of higher ink permeability, the eccentric cams 41 are angularly moved to an angular position shown in FIG. 5(*b*) by the step motor 12, thus increasing the projection length A of the ink-impregnated pad 6 from the ink cartridge holder 4 thereby to increase the volume of the ink-impregnated pad 6 to be pressed. On the other hand, when the print paper P is of lower ink permeability, the eccentric cams 41 are angularly moved to an angular position shown in FIG. 5(*c*) by the step motor 12, thus reducing the projection of the ink-impregnated pad 6 from the ink cartridge holder 4 thereby to reduce the volume of the ink-impregnated pad 6 to be pressed. Therefore, the projection length A of the ink-impregnated pad 6 from the ink cartridge holder 4 at the time the eccentric cams 42 are in the angular position shown in FIG. 5(*b*) is greater than the projection length B of the ink-impregnated pad 6 from the ink cartridge holder 4 at the time the eccentric cams 42 are in the angular position shown in FIG. 5(*c*).

Then, the stamp device is placed in a desired position on the print paper P, and the grip portion 1*a* is manually pressed downwardly toward the print paper P. The ink cartridge 5 is moved downwardly while compressing the compression spring 3 until the heat-sensitive stencil paper 7 contacts the print paper P, whereupon the ink starts being transferred from the ink-impregnated pad 6 through the heat-sensitive stencil paper 7 to the print paper P.

Since the paper quality mode is selected depending on the quality of the print paper P used, the stamp device according to this embodiment can print clear images stably on print papers of different qualities. Thus, the stamp device is capable of printing clear images stably on print papers of different qualities because the print density can be adjusted depending on the quality of the print paper used by controlling projecting amount of the ink-impregnated pad from the cartridge holder.

A stamp device according to a second embodiment will next be described with reference to FIGS. 6 through 12, wherein like parts and components are designated by the same reference numerals as those shown in the first embodiment.

Figure 6:
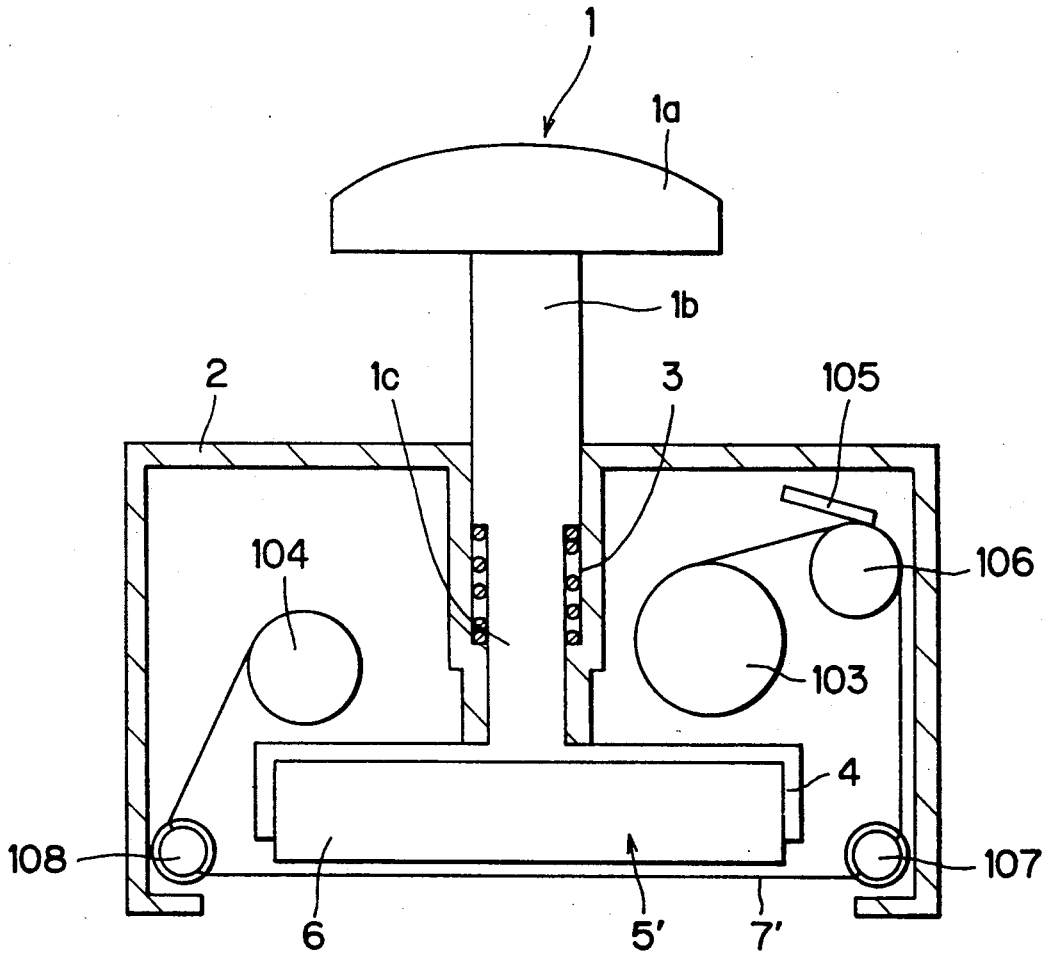
FIG. 6 is a schematic cross-sectional view showing a stamp device according to an inhouse proposal.

Before explaining the details of the second embodiment, one inhouse proposal will be described with reference to FIGS. 6 through 8. According to the inhouse proposal, an elongated rolled heat sensitive stencil paper 7' has been used. The heat sensitive stencil paper 7' has end portions rolled on a supply roller 103 and a takeup roller 104. The heat sensitive stencil paper drawn from the supply roller 103 is fed between a platen roller 106 and a thermal head 105 positioned upper rightward of the supply roller 103. The stencil paper 7' is further passed through a supply guide roller 107 and a takeup guide roller 108 and is taken up by the takeup roller 104.

Flanges are provided at both axial ends of the supply guide roller 107 and the takeup guide roller 108, the flanges defining a distance corresponding to a width of the heat sensitive stencil paper 7' so as to avoid meandering travel thereof during its transferring state.

The ink-impregnated pad 6 is positioned between the supply guide roller 107 and the takeup guide roller 108. The compression coil spring 3 is disposed between the holder and the frame 2 for urging the cartridge holder 90 in a direction for abutting the latter onto the frame 2, so that the heat sensitive stencil paper 7' can be transferred without any contact with the ink-impregnated pad 6.

With this structure, during perforating operation, a perforated image is formed on the thermoplastic film layer by the thermal head 31 (FIG. 4) in accordance with an external image signal while the heat sensitive stencil paper 7' is taken up by the takeup roller 104. The take-up operation by the takeup roller 104 is temporarily stopped when the perforated image is brought to a position immediately below the ink-impregnated pad 6.

When the perforated image in the heat sensitive stencil paper 7' is transferred to the position below the ink-impregnated pad 6, the grip 1 is depressed downwardly, for moving the cartridge holder 5' downwardly. Thus, the ink impregnated pad 6 is depressed against the print paper through the heat sensitive stencil paper 7'. As a result, ink is flowed from the ink impregnated pad 6, and the flowed ink is permeated into the porous base layer 35 of the heat sensitive stencil paper 7', and the ink is then transferred onto the print paper through perforations of the perforated image, whereby a printing is achievable.

Figure 7:
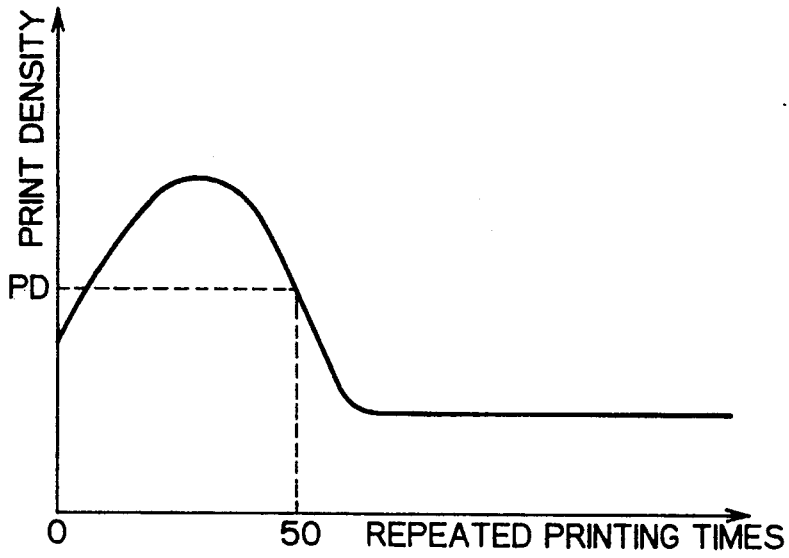
FIG. 7 is a graphical representation showing the relationship between the print density and the printing times.
Figure 8:
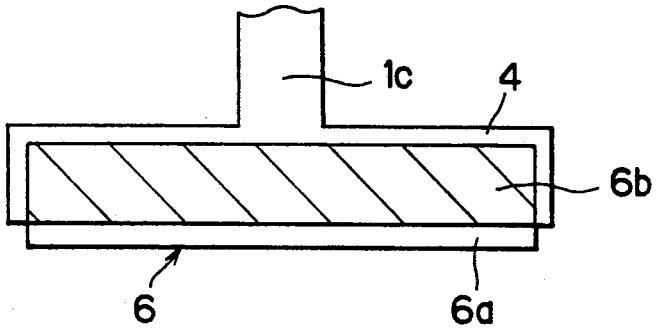
FIG. 8 is a view for description of ink distribution in the ink impregnated pad in the stamp device according to the inhouse proposal.
Figure 9:
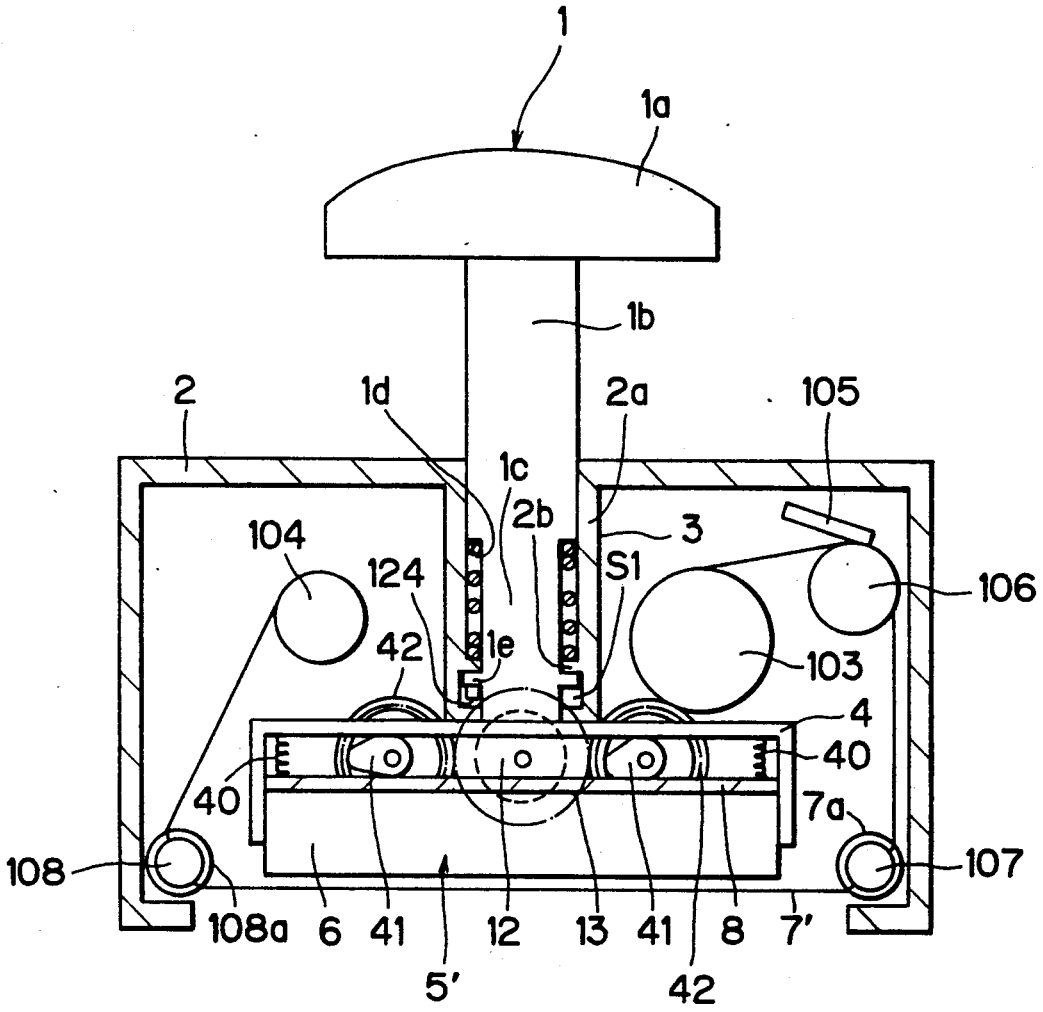
FIG. 9 is a cross-sectional view showing a stamp device according to a second embodiment of the present invention.

However, if printing is continuously carried out with the identical perforated image in the stamp device thus constructed above, the printing times and printing density have the relationship shown in FIG. 7. That is, if the printing times exceeds 50 times, the printing density may be lower than a given printing density to be required for a given printing quality (limit density PD in terms of the printing quality).

This is due to the fact that since a compressed portion 6*a* protruded from the cartridge holder 4 is fixedly exposed irrespective of pressing load, it is impossible to compress the ink-impregnated pad 6 at its maximum level. Therefore, a state shown in FIG. 8 is provided if the ink impregnated in the lower compressible portion of the ink-impregnated pad 6 is used up. That is, minute ink passages at the protruded portion 6*a* may be collapsed or more narrowed due to repeated applied pressure. Moreover, since the ink permeating speed is low, the ink cannot be promptly impregnated into a portion where the ink has been used up.

Figure 1:
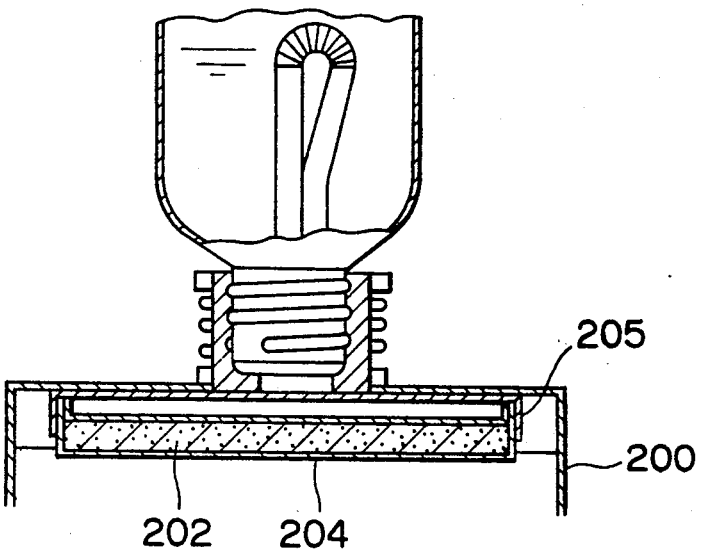
FIG. 1 Prior Art
FIG. 1 is a cross-sectional view showing a conventional stamp device.

Further, extremely long period is required for permeating an ink at an upper portion 6*b* of the ink-impregnated pad 6 into the compressible portion 6*a*. Therefore, a printing limit exists for conducting the continuous printing. Apparently this drawback is also available in the conventional stamp device shown in FIG. 1.

The stamp device according to the second embodiment has been provided as shown in FIGS. 9 through 12 in an attempt to overcome the above described drawback.

The ink cartridge 5' is positioned between the supply guide roller 107 and the takeup guide roller 108. Further, the outer frame 2 is formed with a sleeve portion 2*a* in which an annular projection 2*b* is provided which extends radially inwardly. The compression spring 3 is interposed between the stepped portion 1*d* and the annular projection 2*b*.

Further, the shaft portion 1c of the grip 1 is integrally provided with an annular projection 1e abuttable on the annular projection 2b. An annular chamber S1 is provided below the annular projection 1e and within the sleeve portion 2a, and a microswitch 124 is attached to a lower surface of the annular projection 1e. The biasing force of the spring 3 permits an upper surface of the annular projection 1e to abut on the lower surface of the annular projection 2b, so that the ink-impregnated pad 6 is moved away from the heat sensitive stencil paper 7' during its travel. Between the ink-impregnated pad 6 and the pad holder 4, there are provided the projection adjusting means similar to the first embodiment. The microswitch 124 attached to the lower face of the annular projection le is positioned above the cartridge holder 4.

Figure 11:
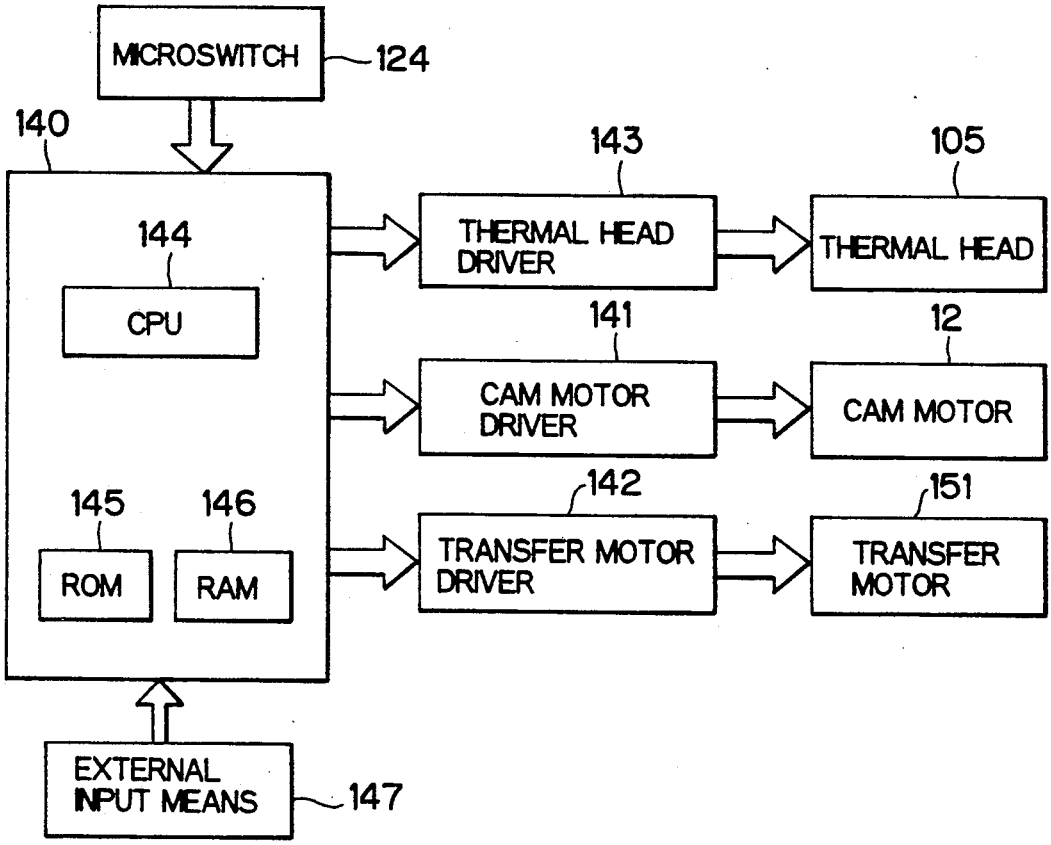
FIG. 11 is a block diagram showing an electrical arrangement in the stamp device according to the second embodiment.

Next, a control arrangement in the second embodiment will be described with reference to a block diagram shown in FIG. 11. A microcomputer 140 includes a CPU 144, a ROM 145, and a RAM 146, To the microcomputer 140 are connected an external input means 147, the microswitch 124, a cam motor driver 141, a transfer motor driver 142 and a thermal head driver 143. In the ROM 145, are stored a program for controlling overall operation of the stamp device and stamp printing pattern data. The RAM 146 stores therein a signal transmitted from the microswitch 124 through the CPU 144, data transmitted from the external input means 147, and various parameters for the required control. The drivers 141, 142, 143 are respectively connected to the cam motor 12, a transfer motor 151 and the thermal head 105. In response to signals from the CPU 144, the cam motor driver control angular rotation angle of the cam motor 12, the transfer motor driver 142 controls the transfer motor 151 in order to control transfer amount of the heat sensitive stencil paper 7'.

A plurality of heat generating elements (not shown) are arrayed in the thermal head 105. Each of the heat generating elements are closely arranged side by side in an array in a direction perpendicular to the transferring direction of the heat sensitive stencil paper. In accordance with the transferring operation for the heat sensitive stencil paper 7', the heat generating elements are selectively driven at a predetermined timings, so that thermal perforating image is formed on the heat sensitive stencil paper 7' in accordance with the input data. The thermal head driver 143 controls pulse width of a drive pulse signal in order to provide a surface temperature of each heat generating element, the temperature being suitable for the thermal perforation. The microswitch 124 is rendered OFF at out of stamping phase. The switch 124 is rendered ON at the time of stamping for transmitting ON-signal to the CPU 144.

Next, printing operation in the thus constructed stamp device of the second embodiment will be described.

At the time of printing, the heat sensitive stencil paper 7' nipped between the thermal head 105 and the platen 106 at a predetermined nipping pressure is formed with perforated image at the thermoplastic film layer side by the operation of the thermal head 105 in accordance with the data sent from the microcomputer 140. The stencil paper is then supplied, so that the perforated image portion is brought into a position below the ink-impregnated pad 6.

When the perforated image portion is positioned below the ink-impregnated pad 6, the grip 1 is depressed downwardly with respect to the print paper. Therefore, the cartridge holder 4 is also depressed downwardly for flowing the ink out of the ink-impregnated pad 6. The ink is permeated into the porous base layer and is permeated into the print paper through the perforations in the thermoplastic film layer. Thus, printing is carried out. At the same time, the microswitch 124 provided at the lower side of the annular projection 1e is rendered ON, and the ON signal is transmitted to the CPU 144.

Upon completion of the printing, the grip 1 restores its original position by the biasing force of the compression coil spring 3, such that the upper portion of the annular projection 1e abuts the annular projection 2b of the frame 2. Thus, the microswitch 124 is rendered OFF.

Figure 10:
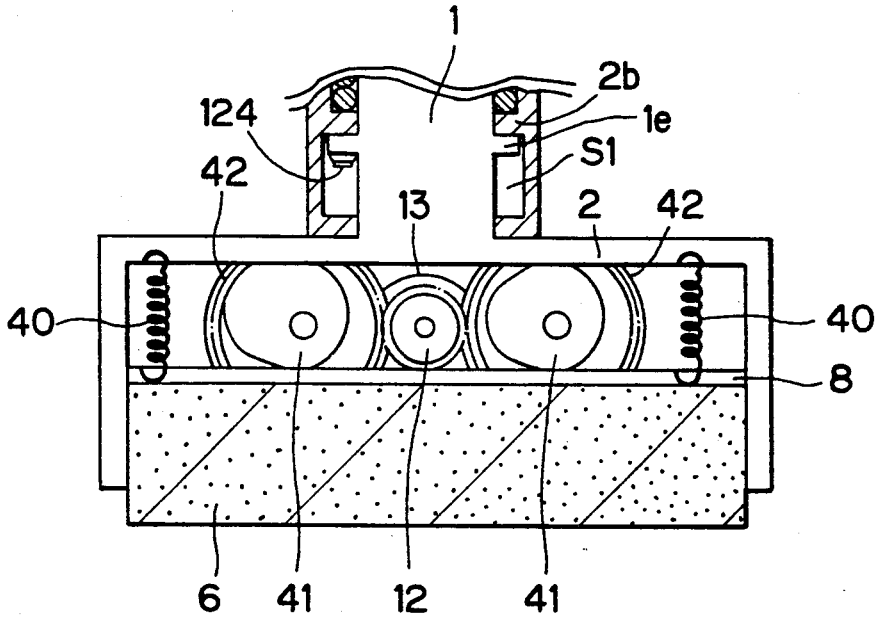
FIG. 10 is a cross-sectional side view showing a details of a protruding portion of an ink-impregnated pad according to the second embodiment of this invention.

Next, continuous printing operation will be described with reference to FIGS. 10 through 12.

As described above, at each time the grip 1 is depressed, the CPU 144 counts printing times, that is, grip depression times are counted in the CPU in response to the ON signals from the microswitch 124. The count value is temporarily stored in the RAM 146. The CPU 144 compares the count value with a preset value stored in the ROM 145. If judgement falls that the count value is greater than the preset value, CPU transmits the signal to the cam motor driver 141 so as to change the angular rotation angle of the cams 41. By the angular rotation of the cam motor 12, the pressure cams 41 are angularly rotated by way of the motor gear 13 and the cam gears 42. Incidentally, the rotation angle of the cam motor provides a desired displacement of the pressure cams capable of providing sufficient protruding amount of the ink-impregnated pad 9 from the holder 4 for the desired printing within a preset range. For example, the continuous or repeated printing times is set to 300 times for providing a given printing quality.

In this case, the pressure cams 41 have such configuration that a protruding amount "a" capable of performing repeated 50 times printing is defined as being a fundamental protruded increasing amount and the cam has maximumly "10a" displacing amount for covering 10 stages.

"50" times is stored in the ROM 150 as the preset value, and the cam motor 12 is rotated such that the displacing amount in the radial direction of the pressure cams 41 is increased by "a" at every 50 times printing. By such rotation of the pressure cams 41, the pad securing plate 14 is depressed downwardly for increasing the protruding amount of the ink-impregnated pad 6.

Figure 12:
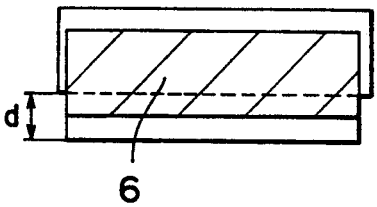
FIG. 12 is a view for description of ink distribution in the ink impregnated pad according to the second embodiment.

According to the stamp device of the second embodiment, the protruded portion of the ink-impregnated pad 6 from the holder 4 always contain an ink retaining portion d as shown in FIG. 12. Therefore, ink in the ink-impregnated pad 6 is efficiently utilized, to thereby increase repeated printing numbers. Thus, in the stamp device according to the second invention, repeated printing numbers can be increased by increasing the protruding amount of the ink-impregnated pad in accordance with the printing times. Thus, it is possible to efficiently use the ink retained in the ink-impregnated pad.

Thus, according to the present invention, the inked image can provides sufficient density regardless of kind of the image receiving sheet and regardless of printing times because of the control to the projection length of the pad relative to the holder 4.

While the invention has been described in detail and with reference to the specific embodiments thereof, it would be apparent to those skilled in the art that various changes and modifications may be made therein without departing from the spirit and scope of the invention. For example, increase in protruding amount of the ink impregnated pad is attained by the employment of the pressure cams in the above described embodiment. However, for vertically moving the ink-impregnated pad which always extends in a horizontal direction, racks are provided at both sides of the pad securing plate 8, and the racks can be engaged with the gears.

What is claimed is:

1. A stamp device for providing an inked image on an image receiving sheet through a heat sensitive stencil paper in which a perforated image section is formed, the stamp device comprising:

an outer frame;

a pressure means movably supported by the outer frame;

an ink cartridge having an ink-impregnated pad contactable with the image receiving sheet through the perforated stencil paper for transferring an ink in the ink-impregnated pad to the image receiving sheet through the perforated imaging section;

a pad holder for supporting the ink cartridge, the pressure means being connected to the pad holder for providing projected and retracted positions of the ink-impregnated pad relative to the outer frame; and projection length adjusting means positioned between the pad holder and the ink cartridge for adjusting a projecting amount of the ink-impregnated pad from the pad holder.

2. The stamp device as claimed in claim 1, further comprising a biasing means provided between the pressure means and the outer frame for urging the pad holder toward the retracted position.

3. The stamp device as claimed in claim 2, wherein the projection length adjusting means comprises:

a drive motor supported on the pad holder;

at least one cam member rotatably supported by the pad holder and positioned between the pad holder and the ink cartridge; and power transmission means provided between the drive motor and the cam member, angular rotation of the cam member providing a vertical displacement of the ink cartridge relative to the pad holder.

4. The stamp device as claimed in claim 3, wherein the projection length adjusting means further comprises:

a control means for controlling the drive motor;

a print mode change means connected to the control means for outputting a signal indicative of a rotation degree of the drive motor so as to control angular rotational amount of the cam member, to thus adjust a printed density depending on ink permeability of the image receiving sheet.

5. The stamp device as claimed in claim 4, wherein the projection length adjusting means further comprises at least one second biasing means provided between the pad holder and the ink cartridge for normally urging the ink cartridge into the pad holder.

6. The stamp device as claimed in claim 5, further comprises a one way clutch provided at the pad holder for rotatably supporting a cam shaft to which the cam member is fixedly provided.

7. The stamp device as claimed in claim 6, wherein the ink cartridge further comprises a pad securing plate for securing an upper portion of the ink-impregnated pad, the cam member being in contact with the pad securing plate.

8. The stamp device as claimed in claim 7, wherein the heat sensitive stencil paper is provided in contact with a lower surface of the ink-impregnated pad.

9. The stamp device as claimed in claim 3, wherein the projection length adjusting means further comprises control means for controlling the pad holder in order to increase the projection length in accordance with printing times.

10. The stamp device as claimed in claim 9, wherein the control means comprises:

means for storing a preset printing times;

means for counting actual printing times; and means for comparing the preset printing times with the actual printing times and for generating a drive signal to the drive motor if the actual printing times exceeds the preset printing times.

11. The stamp device as claimed in claim 10, wherein the counting means comprises a microswitch.

12. The stamp device as claimed in claim 11, wherein the microswitch is disposed at the pressure means, a count signal being generated when the microswitch abuts a stationary portion.

13. The stamp device as claimed in claim 12, further comprising:

a supply roll rotatably disposed within the outer frame;

a takeup roll rotatably disposed within the outer frame, the heat sensitive stencil paper being an elongated web supplied from the supply roll and taken-up by the takeup roll; and a pair of guide rolls disposed beside the ink cartridge for traveling the elongated heat sensitive stencil paper below the ink cartridge.

14. The stamp device as claimed in claim 13, further comprising a thermal head disposed within the outer frame and at a position contactable with the heat sensitive stencil paper for forming the perforated image section thereon.

15. The stamp device as claimed in claim 14, wherein the projection length adjusting means further comprises at least one second biasing means provided between the pad holder and the ink cartridge for normally urging the ink cartridge into the pad holder.

16. The stamp device as claimed in claim 15, further comprises a one way clutch provided at the pad holder for rotatably supporting a cam shaft to which the cam member is fixedly provided.

17. The stamp device as claimed in claim 16, wherein the ink cartridge further comprises a pad securing plate for securing an upper portion of the ink-impregnated pad, the cam member being in contact with the pad securing plate.

* * * * *